US006675775B2

(12) United States Patent
da Cunha et al.

(10) Patent No.: US 6,675,775 B2
(45) Date of Patent: Jan. 13, 2004

(54) SYSTEM AND METHOD FOR DELIVERING COMBUSTIBLE LIQUIDS

(75) Inventors: John M. da Cunha, Corvallis, OR (US); Michael J. Barbour, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 29 days.

(21) Appl. No.: 10/120,951

(22) Filed: Apr. 10, 2002

(65) Prior Publication Data

US 2003/0192511 A1 Oct. 16, 2003

(51) Int. Cl.[7] ..... F02M 5/100
(52) U.S. Cl. ..... 123/478; 123/472
(58) Field of Search ..... 123/472, 478, 123/480; 239/102.2, 4; 222/571, DIG. 1

(56) References Cited

U.S. PATENT DOCUMENTS

| | | | | | |
|---|---|---|---|---|---|
| 3,717,875 | A | * | 2/1973 | Arciprete et al. | 347/73 |
| 5,099,815 | A | * | 3/1992 | Yamauchi et al. | 123/472 |
| 5,165,373 | A | * | 11/1992 | Cheng | 123/300 |
| 6,162,589 | A | * | 12/2000 | Chen et al. | 430/320 |
| 6,213,099 | B1 | | 4/2001 | Calvas et al. | 123/490 |
| 6,257,205 | B1 | | 7/2001 | Calvas et al. | 123/470 |
| 6,405,936 | B1 | * | 6/2002 | Ganan-Calvo | 239/8 |

* cited by examiner

*Primary Examiner*—Mahmoud Gimie

(57) ABSTRACT

A fuel injector includes a drop ejector for discretely ejecting drops of combustible liquid in a digital manner. An electronic circuit controls the operation of the drop ejector, and, in particular, the amount of fuel supplied by the drop ejector by adjusting the number of ejected drops during a given time frame.

14 Claims, 8 Drawing Sheets

SYSTEM AND METHOD FOR DELIVERING COMBUSTIBLE LIQUIDS

BACKGROUND

The present invention generally relates to engine fuel systems and, more particularly, to combustible fuel devices that generate combustible vapors such as internal combustion engines.

Heretofore, combustible vapors were directed into the cylinders of internal combustion engines using either carburetors or fuel injectors. Fuel injectors were either continuous or pulsed. The continuous fuel injectors directed the combustible vapor into an intake manifold, and when an intake valve opened, the vapor was drawn into the cylinder by the piston. The pulsed fuel injectors directed fuel vapor on command into either a region upstream of each intake valve or directly into the combustion chambers. Both of these fuel delivery systems are highly developed, well known, and have been in use for decades.

As environmental regulations become more and more stringent, there is an increasing need for more precise control of the fuel/air stoichiometry in the combustion chambers of an engine. Several problems continue to persist in conventional fuel delivery technology. For instance, if excessive fuel is used or too little air is mixed with the fuel, the amount of hydrocarbon emissions increases correspondingly. Also, for fuel injectors, the orifices change in size over time; they get larger due to mechanical wear and smaller due to clogging from both the constituents in the fuel and small particles that are not removed by the fuel filter. In addition, the requirement for more precise fuel and air metering to meet environmental and fuel economy regulations has caused both carburetors and fuel injectors to become more and more expensive.

There is also a need for an inexpensive, simple fuel delivery system for small industrial engines, those having about twenty-five horsepower or less. These are the engines used on lawn mowers, rotary tillers, outboards and scooters, for example. These engines are increasingly being subject to environmental regulation, but it is impractical to incorporate a conventional fuel delivery system that costs as much or more than the rest of the machine.

Further, with these conventional fuel delivery systems, reliability continues to be a problem. For example, a conventional fuel injection system requires high-pressure pumps and carefully engineered fuel conduits, tubing, and connections that must withstand constant vibration and extreme variations in operating temperature.

It is apparent from the foregoing that although there are well-developed engine fuel delivery systems, there is a need for an approach that meets increasingly stringent environmental regulations, is reliable and inexpensive, and more precisely controls the fuel-air stoichiometry in combustion chambers.

SUMMARY

Briefly and in general terms, an apparatus according to the invention includes (i) a drop ejector capable of discretely ejecting a combustible liquid in a digital manner, and (ii) a means for providing a pulse-modulated control signal to said drop ejector, wherein said pulse-modulated control signal is indicative of a desired number of drops to be ejected from said drop ejector within a given time frame.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention is better understood with reference to the following drawings. The elements of the drawings are not necessarily to scale relative to each other. Rather, emphasis has instead been placed upon clearly illustrating the invention. Furthermore, like reference numerals designate corresponding similar parts through the several views.

DETAILED DESCRIPTION

Figure 1:
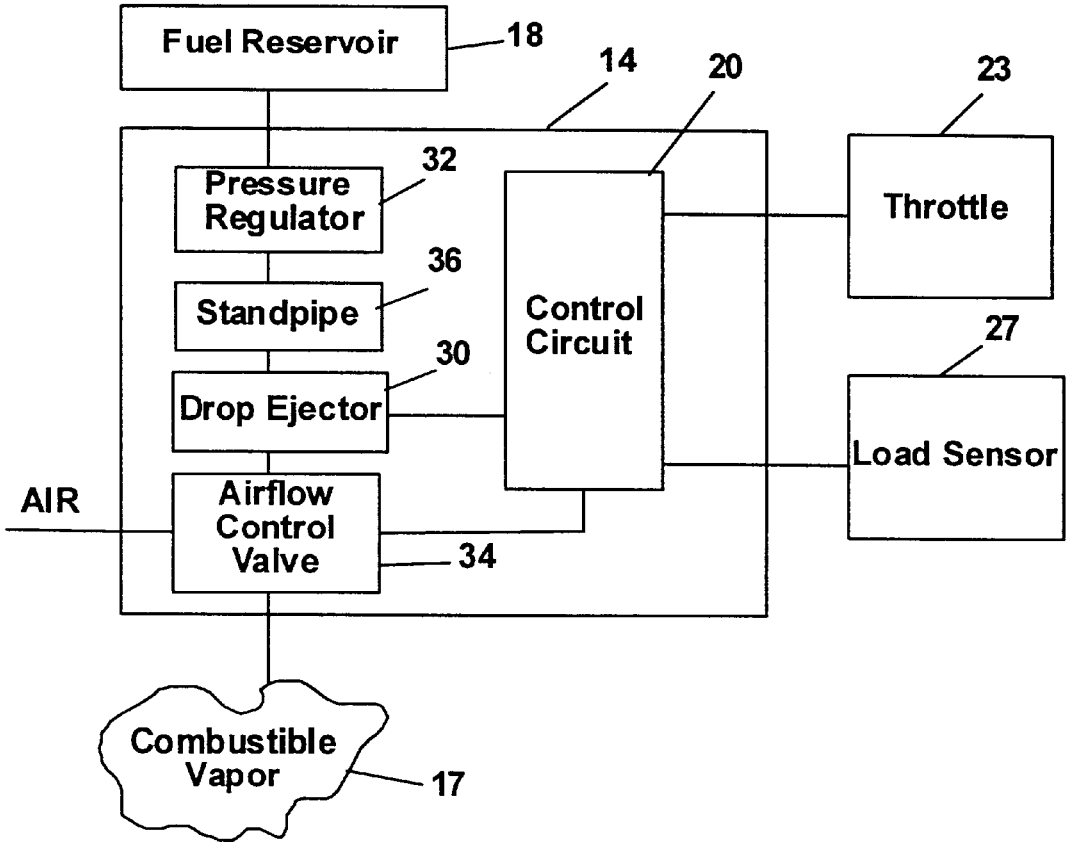
FIG. 1 is a is a block diagram of an exemplary embodiment of the invention.

FIG. 1 is a block diagram of one embodiment of the invention. Reference numeral 14 generally indicates an apparatus for generating a combustible vapor for an internal combustion engine, hereinafter called a "fuel injector" for brevity. A fuel injector 14 includes a drop ejector 30 and an airflow control valve 34. The drop ejector 30 creates discrete numbers of drops of a substantially fixed quantum of size. The drop ejector 30 is fluidically connected, preferably under low pressure, to a fuel reservoir 18 containing combustible fuel. The fuel from the fuel reservoir 18 is preferably delivered to the drop ejector using a pressure regulator 32 and an operational standpipe 36 to prevent fuel leakage from the drop ejector 30 in non-use-situations. Preferably, the drop ejector 30 is removable and replaceable by a typical consumer. A control circuit 20 controls the drop ejector 30 and airflow control valve 34. The control circuit 20 is preferably connected to a throttle 23, which is controlled by a user, and a load sensor 27 that monitors and senses the load of the combustible fuel device. The airflow control valve 34 regulates the flow of air that is mixed with the fuel ejected from the drop ejector 30 to create a combustible vapor 17 used by the internal combustion engine or other combustible fuel device.

Figure 2:
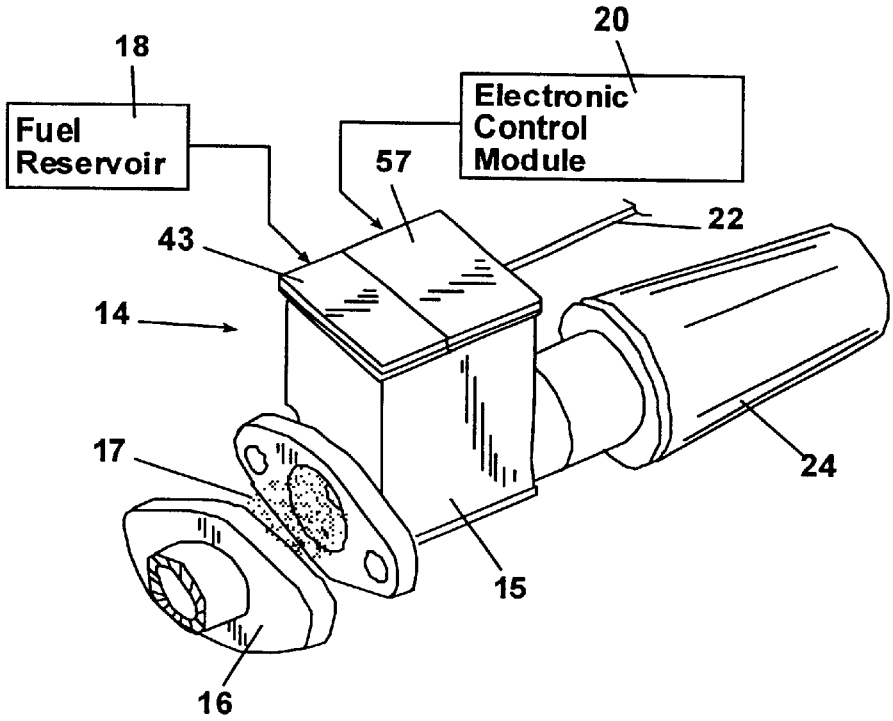
FIG. 2 is a top, side and perspective view, partially diagrammatic, of an apparatus for generating a combustible vapor for an internal combustion engine according to an exemplary embodiment of the invention.
Figure 3:
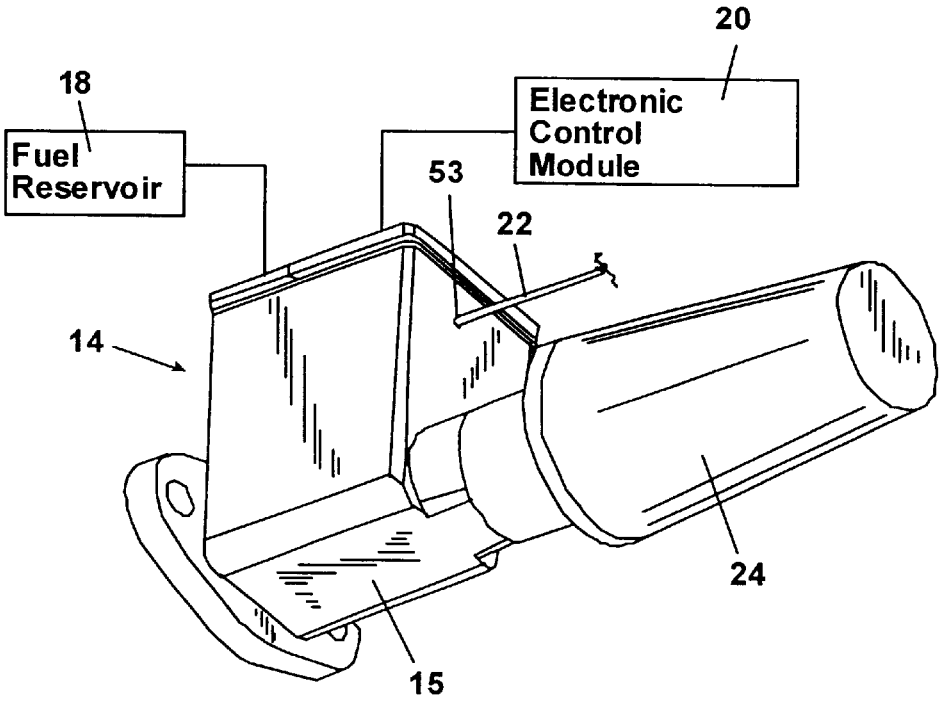
FIG. 3 is a bottom, side and perspective view, partially diagrammatic of the apparatus of FIG. 2.

FIGS. 2–10 illustrate various views and perspectives of an embodiment of the present invention, which includes additional details of the fuel injector 14 relative to the block diagram of FIG. 1. Referring first to FIGS. 2 and 3, the fuel injector 14 has a main body 15 that is mounted either on an intake manifold 16 or proximate to the intake valves (not shown) of an internal combustion engine. The main body 15 and all of the parts, unless noted otherwise in this document, are preferably made of Nylon 6, an injected molded polymer that is resistant to gasoline and other engine fuels. The fuel injector can be used on either 2 cycle or 4 cycle spark ignition engines or 2 cycle or 4 cycle compression ignition engines. A function of the fuel injector is to produce very small, metered quantum or digital drops of combustible fuel and to channel a controlled amount of air through the drops and thereby generate a combustible vapor 17. The combustible vapor 17 is drawn into the cylinders of the engine by either the vacuum created by the motion of the piston(s) or by an exterior air pump, not shown, such as a supercharger and/or a turbocharger.

In FIGS. 2 and 3, connected to the main body 15 is a fuel reservoir 18. The fuel reservoir may or may not be connected to a fuel pump (not shown) but gravity feed of the fuel is inexpensive and is preferable because only a minimal fuel pressure is required for the fuel injector. The fuel can be any type of gasoline, Diesel fuels, alcohols, fuel oils and kerosenes, in short, any combustible fuel or fuel combination that will power an internal combustion engine or other combustible fuel device such as lanterns, stove, heaters and generators.

In FIGS. 2 and 3, the fuel injector 14 is connected to electronic control module 20. This module 20 and its functions are described below in connection with FIG. 12. Reference numeral 22 indicates a throttle cable that is connected to either a manual throttle or a foot pedal (not shown). As described below, when the throttle cable 22 is pulled away from the main body 15, the fuel injector 14 channels a greater volume of air through the apparatus and into the engine. A conventional air filter 24 removes any particulate matter in the air stream entering the fuel injector 14 thus filtering the air.

Figure 9:
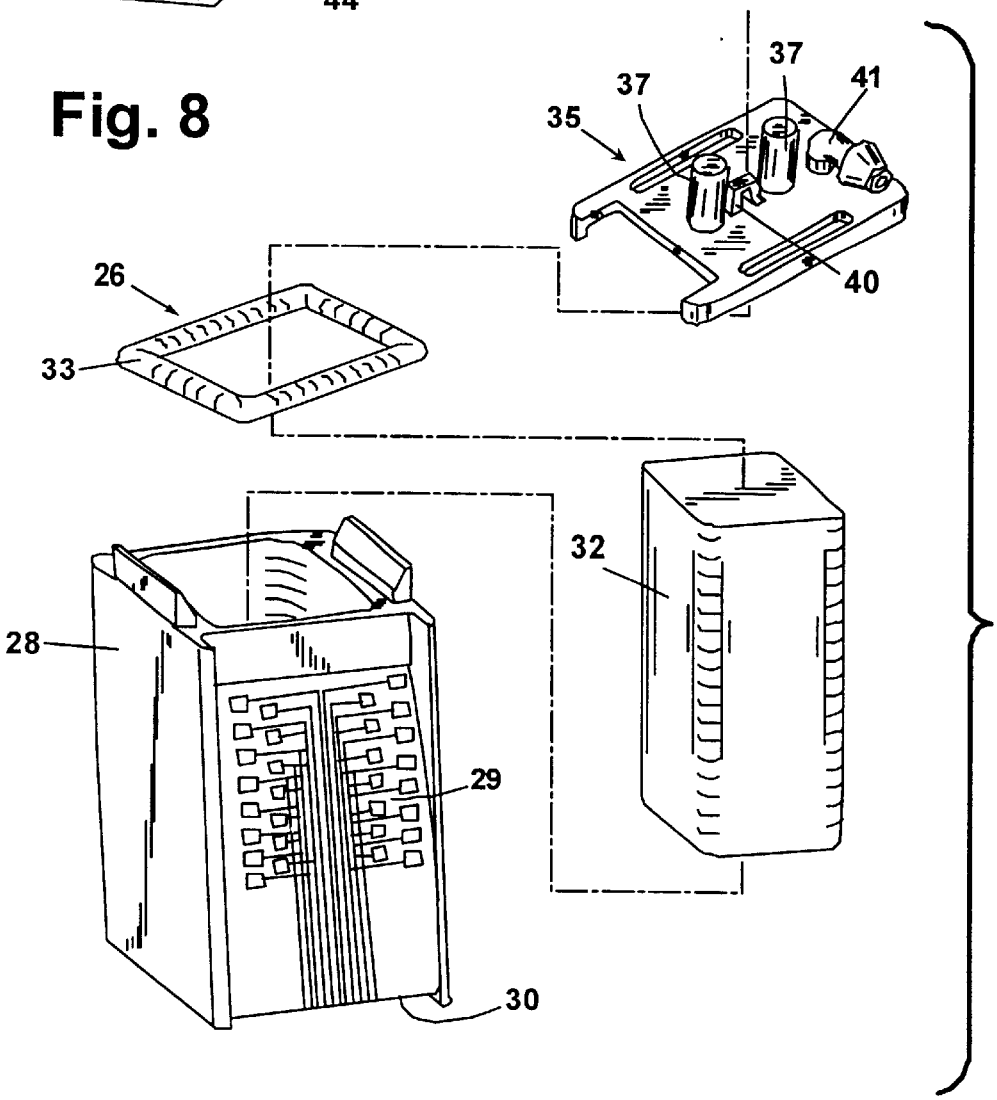
FIG. 9 is an exploded view of the micro-pump of the apparatus of FIG. 2.

Referring to FIG. 9, reference numeral 26 generally indicates a slide body, preferably replaceable, that functions both as a micro-pump for the fuel and an air control valve that regulates the amount of air that is directed into the stream of fuel droplets produced by the micro-pump. The slide body 26 is constructed similar to and operates in essentially the same manner as a thermal ink jet print cartridge. However, the various properties of the desired fuel used, such as surface tension, chemical reactivity, and volatility, to name a few, require that modifications be made to the design of conventional thermal ink jet print cartridges and thus prevents simple replacing ink with fuel. Such changes include reducing the capillary sizes in the standpipe 36 between the backpressure regulator 32 and the drop ejector 30 to account for a lower surface tension. Other changes include selection of materials for the body 15 and backpressure regulator 32 that are resistant to the fuel's solubility, such as Nylon 6. Further, the backpressure regulation must be adapted to account for the higher volatility of the fuel.

Figure 4:
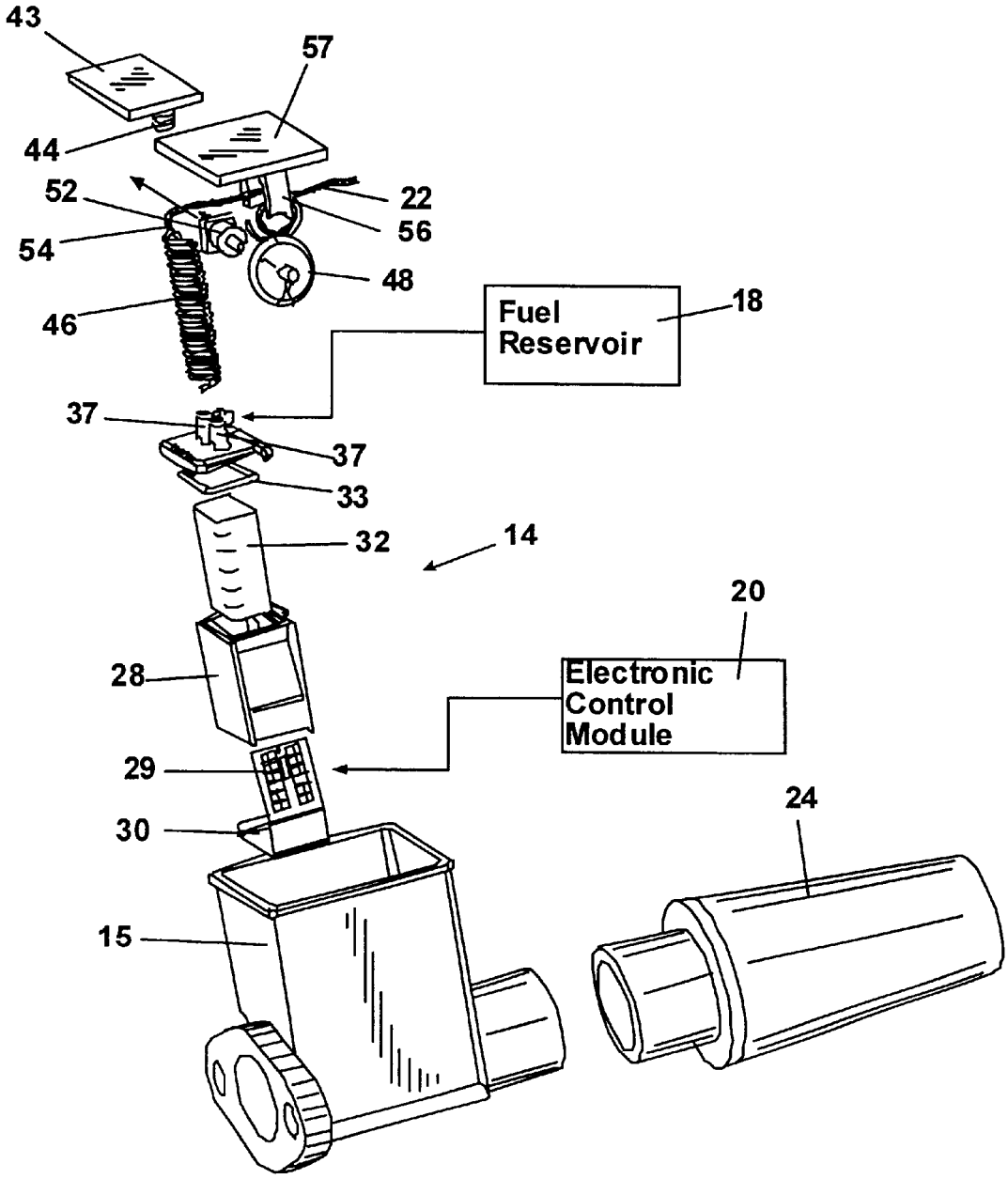
FIG. 4 is an exploded view, partially diagrammatic, of the apparatus of FIG. 2.
Figure 5:
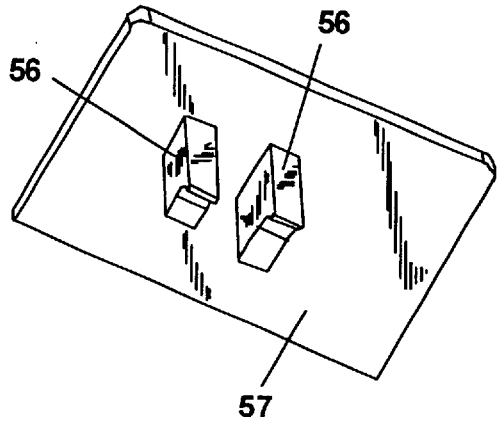
FIGS. 5–8 are perspective views of some of the components of the apparatus of FIG. 2.

In this exemplary embodiment, the slide body 26 includes a housing 28, upon which is mounted a TAB circuit 29. Other forms of interconnection are known to those skilled in the art and can be substituted for the TAB circuit 29 and still remain within the spirit and scope of the invention. The TAB circuit 29 is electrically connected to the electronic control module 20 described below in connection to FIG. 12. The TAB circuit 29 is also electrically and physically connected to drop ejector 30 located on the bottom wall of the housing 28. An exemplary drop ejector is described in U.S. Pat. No. 6,162,589 entitled "Direct Imaging Polymer Fluid Jet Orifice" issued on Dec. 19, 2000 to Chen et al, and herein incorporated by reference. A preferred drop ejector 30 contains a plurality of fuel firing chambers; each firing chamber has one or more nozzles, a fuel inlet channel, and an energy dissipation element, such as a resistor or flextentional device that is pulsed by the electronic control module 20. The electronic control module 20 is preferably responsive to engine load and throttle position when embodied in an internal combustion engine application. The drop ejector 30 expels the combustible liquid drop-by-drop for each orifice vertically downward (in this embodiment, although any orientation is possible) from the firing chambers as illustrated in FIGS. 1, 4 and 9. For gasoline, the drops preferably each have a Number Median Diameter (NMD) of less than about 30 microns and a volume of about 14 picoliters, although this can be tailored depending on the design of the drop ejector such as up to an NMD of 1 mm.

Within the housing 28 of FIG. 9 is a pressure regulator 32 that can be either reticulated foam, as illustrated, or a spring bag or a flexible diaphragm. Several other pressure regulators for controlling back pressure are known to those skilled in the art and can be substituted and still fall within the scope and spirit of the invention. The pressure regulator 32 is in fluid communication with the drop ejector 30 through a slot or slots in the standpipe (not shown) located in the bottom of the housing 28. The pressure regulator places a slight negative pressure on the backside of the drop ejector 30 so that the combustible fluid does not leak or dribble out of the drop ejector.

The slide body 26 of FIG. 9 also includes a slide body top 35, and the housing 28 and the top 35 are sealed with a gasket 33 so that the combustible liquid does not leak out of the slide body. The gasket is preferably made from EPDM or polyurethane. On the top wall of the slide body top 35 are two cylindrical features 37 that retain the compression return springs 46 (FIG. 4) in place and an arch 40. The throttle cable 22 (FIG. 2) is connected to the arch 40 as described below, and the motion of the throttle cable causes the slide body 26 to move vertically up and down within a slot 38 (FIG. 7) within the main body 15 of the fuel injector to control the amount of air entering the fuel injector through airway 85 (see FIG. 7).

Also located on the top wall of the slide body 26 (see FIG. 9) is a combustible fuel inlet conduit 41 that is in fluid communication with the fuel reservoir 18 (FIG. 2). Within the main body 15, the fuel inlet conduit 41 is flexible and resiliently deformable so that the slide body 26 can move up and down within the fuel injector without obstruction. The fluid inlet conduit 41 is also in fluid communication with the pressure regulator 32 (FIG. 8).

Figure 8:
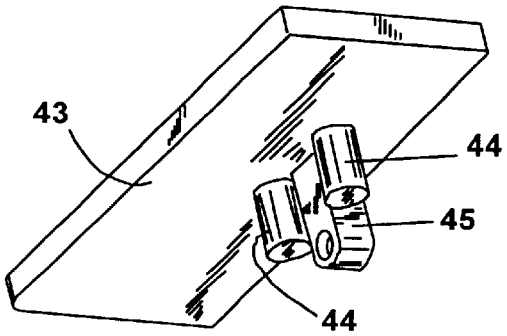
Figure 10:
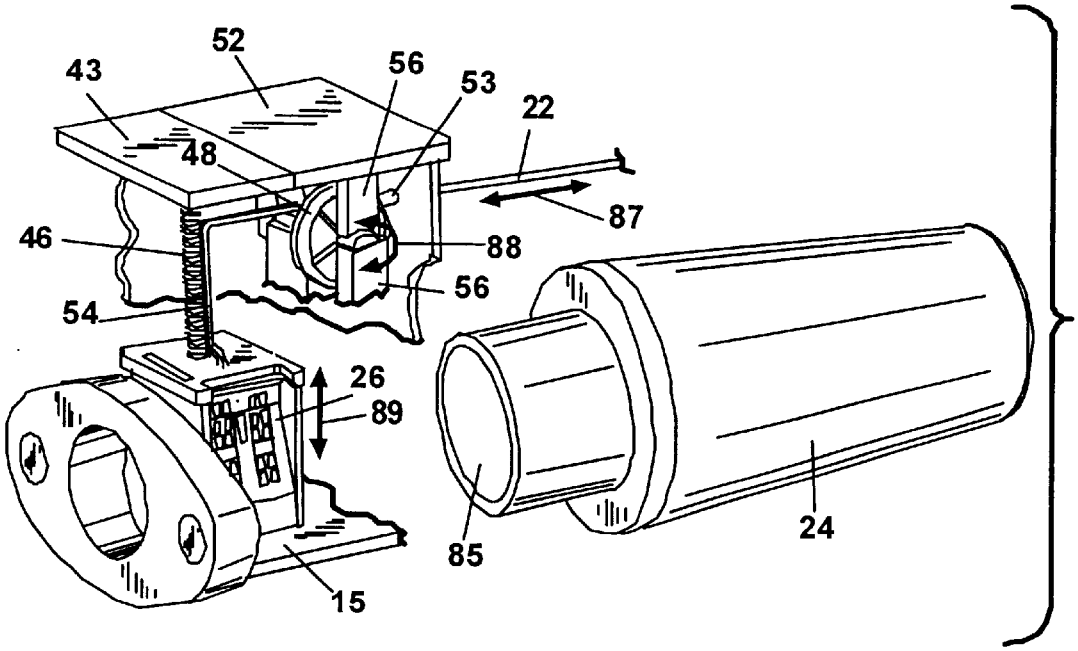
FIG. 10 is a perspective view, partially cut away, of the apparatus of FIG. 2.

Referring to FIGS. 8 and 10, reference numeral 43 indicates a rearward portion of the top wall of the main body 15. Located on the bottom side of this wall 43 (FIG. 8) are two spaced apart cylindrical features 44. After assembly of the fuel injector, these cylindrical features 44 are co-axial with the cylindrical features 37 on the slide body top 35 (FIG. 9). The four features together engage and retain two return springs 46 (FIG. 4). The return springs 46 are compression springs and are preferably fabricated from stainless steel. The return springs urge the slide body 26 downward into the main body 15 and into a position that blocks the flow of air through the fuel injector 14. When the slide body 26 is pulled upward by the throttle cable 22, the return springs 46 are compressed. Also located on the bottom side of the top wall 43 is a guide 45 for the throttle cable 22, 54. The function of the guide 45 is to make the throttle cable bend 54, as illustrated in FIGS. 3 and 9. For clarity, the guide 45 is not illustrated in FIGS. 4 and 10.

Figure 6:
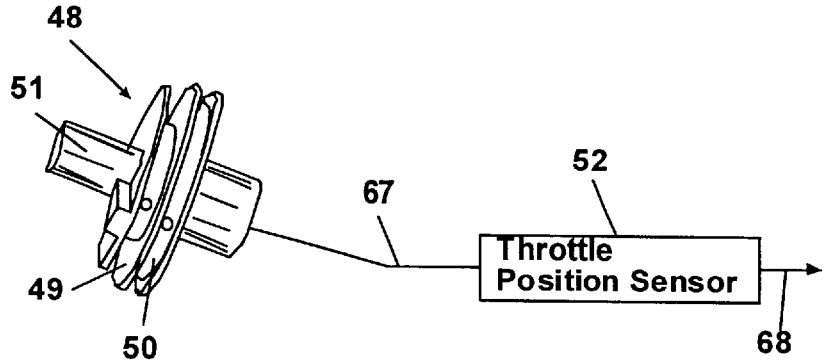
Figure 7:
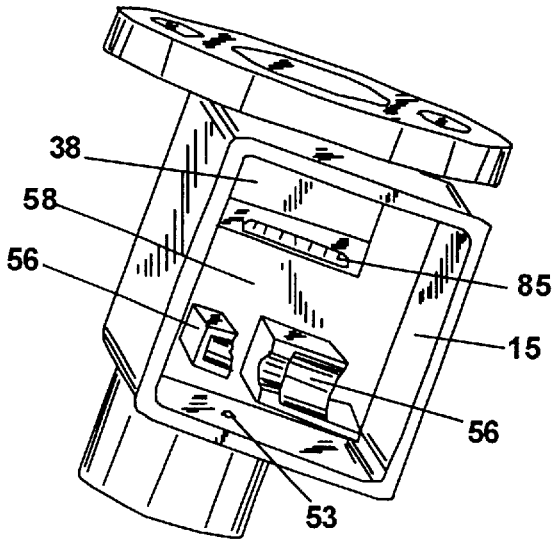

Referring to FIG. 6, reference numeral 48 generally indicates a throttle wheel. The throttle wheel has a smaller spool 49 and a larger spool 50 rigidly mounted on an axle 51. The throttle cable 22 (FIG. 2), connected to the throttle, not shown, passes through a small hole 53 (FIG. 7) in the main body 15 and is wrapped around the larger spool 50. There is a second cable 54 that is wrapped around the smaller spool 49. The second cable 54 passes through the guide 45 (FIG. 8) and is connected to the arch 40 on the slide body top 35 (FIG. 9). The function of the two spools 49, 50, of different diameters is to reduce the overall height of the fuel injector 14. Also, connected to the axle 51 is a throttle position sensor 52, preferably a potentiometer. This sensor measures the radial position of the throttle wheel 48 that corresponds to the vertical position of the slide body 26 within the fuel injector 14. The sensor sends a position signal 68 to the control circuit (see FIG. 12) described below. The throttle wheel 48 is mounted for rotation on four forks 56 in FIGS. 4 and 6. Two of the forks 56 are located on the bottom of the forward portion 57 of the top wall of the main body 15. The other two forks 48 are located on a medial wall 58 within the main body 15.

Figure 11:
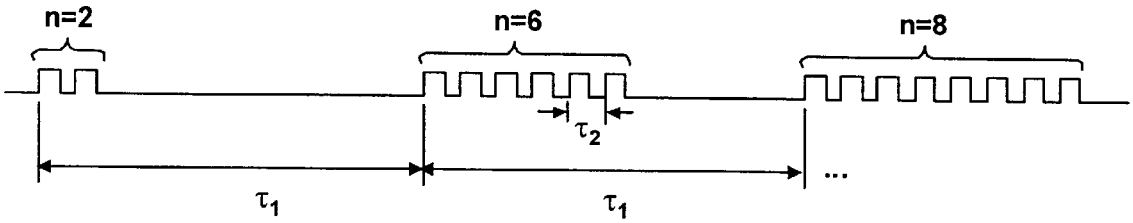
FIG. 11 illustrates an exemplary pulse train used to control an amount of fuel ejected from an embodiment of the invention.

According to a preferred embodiment of the invention, the amount of fuel delivered from the fuel injector is controlled by adjusting the number of fuel drops that are delivered by the fuel injector for a given fixed time period. Thus, the fuel drops are delivered according to a pulse-modulated scheme. FIG. 11 illustrates an exemplary pulse-modulated fuel drop delivery scheme according to a preferred embodiment of the present invention. As shown in FIG. 11, a pulse stream is established wherein a fuel drop is delivered from the fuel injector for each pulse in the pulse stream. For any given fixed time frame $\tau_1$, a variable number of pulses (n) can be applied. Each pulse has a fixed period of $\tau_2$, which represents the time period during which the fuel injector is delivering one or more fuel droplets of a fixed quantum size. FIG. 11 illustrates three different time frames, each having a period of $\tau_1$. In the first time frame, two pulses are applied; in the second time frame, six pulses are applied; and in the third time frame, eight pulses are applied. The greater the number of pulses in a given time frame, the more fuel that is delivered from the fuel injector, and thus, the richer the fuel/air mixture that is delivered to the engine. In this way, a preferred method of controlling the amount of fuel delivered from the fuel injector is according to a pulse-modulated scheme.

Figure 12:
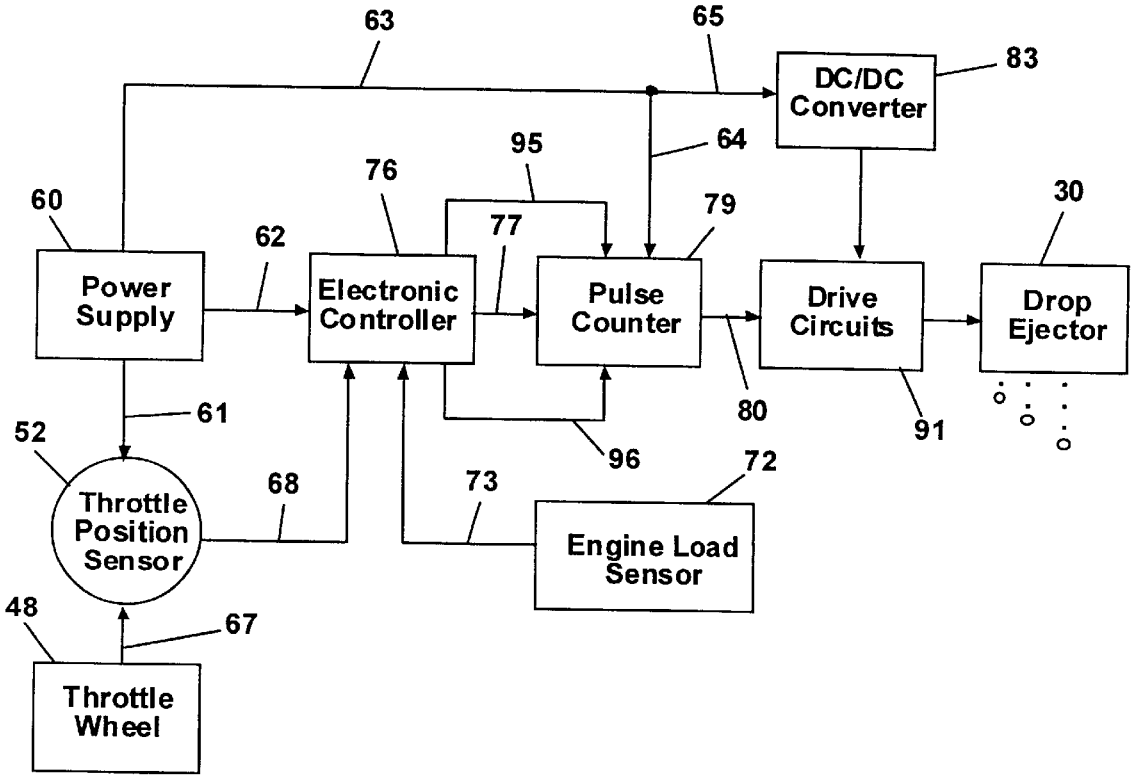
FIG. 12 is a block diagram of the signals and the electrical control circuit illustrated in FIG. 1.

FIG. 12 illustrates an exemplary electronic control circuit and the flow of signals within the electronic control module 20 (FIG. 1) that implements the above-described methodology for controlling the amount of fuel delivered to the engine. The electronic control circuit may be designed and built using analog, digital, or any combination thereof of electrical circuits, including microprocessors. The circuit includes a twelve-volt DC power supply 60 that supplies power to all of the electronics for the fuel injector 14. The power supply may be a battery or a generator driven by the engine. Arrows 61–65 inclusive indicate the twelve-volt DC power distributed to the various sub-circuits.

The throttle wheel 48 illustrated in FIGS. 6 and 10 turns in response to the movement of the throttle cable 22, 54, and the position of the axle 51 is indicated by the arrow 67. The radial position of the throttle wheel 48 and, in turn, the vertical location of the slide body 26 (FIG. 9), within the main body 15 is measured by the throttle position sensor 52, typically and preferably a positioning potentiometer. Arrow 68 is a variable voltage corresponding to the vertical position of the slide body 26 in the fuel injector, and, in turn, the size of the opening of the airway in the fuel injector. This variable voltage is an input to an electronic controller 76.

Reference numeral 72 of FIG. 12 indicates an engine load sensor. The load sensor 72 can take many forms depending on the application. In one application, the load sensor 72 is a tachometer that measures the revolutions per minute of the engine. In another application, the load sensor 72 is an airflow meter that measures the quantity of air entering the fuel injector. On an air-cooled engine, the load sensor 72 is a flow meter measuring the amount of air being moved by the fan. The output voltage signal from the engine load sensor 72 is indicated by arrow 73 and is a second input to the electronic controller 76.

The electronic controller 76 controls the amount of combustible fuel that is ejected from the drop ejector based upon the input signals 68 and 73 from the throttle position sensor 52 and the engine load sensor 72, respectively. Further, while not shown in FIG. 12, other parameters known in the art to be relevant to the desired amount of fuel to be supplied to an engine can also be used as inputs to the electronic controller 76 for this purpose. Collectively, the engine load, throttle position, and other known parameters are referred to herein as "operation conditions" of the apparatus receiving the fuel delivery. Generally, the higher the engine load and/or the more that the throttle is actuated, the greater the amount of fuel that should be ejected from the drop ejector 30. Thus, the greater the desired number of drops that should be ejected from the drop ejector 30 within a given time frame $\tau_1$. The electronic controller 76 and the pulse counter 79 create a pulse train appropriate to eject the desired number of fuel drops within a given time frame.

The electronic controller 76 provides a frame clocking signal 96 to pulse counter 79 every $\tau_1$ seconds. In this way, the period between frame clocking signals is $\tau_1$. The frame clocking signal 96 functions to trigger the pulse counter 79. Controller 76 also provides a $\tau_2$ clocking signal 95 to pulse counter 79 every $\tau_2$ seconds. As a result, a pulse train is established having a period of $\tau_2$. Finally, controller 76 provides a load counter signal 77 to pulse counter 79, which represents the number of fuel drops that should be ejected from the drop ejector 30. Based upon the load counter signal 77, the pulse counter 79 provides a certain number (n) of pulses 80 to drive circuits 91. In operation, the frame clocking signal 96 triggers the pulse counter 79, which, in turn, passes a pulse to the drive circuits 91 each time the pulse counter 79 receives a $\tau_2$ clocking signal. The pulse counter 79 continues this process until it has delivered (n) pulses, at which time it stops providing pulses until it receives the next frame clocking signal 96.

The pulses 80 are provided to drive circuits 91, which amplify the pulses 80 sufficiently to activate the drop ejector 30. Each time the drop ejector receives a pulse, it ejects a drop of fuel. Thus, the more pulses that the drop ejector receives during a given fixed time period $\tau_1$, the greater the amount of fuel that is delivered to the engine.

Now, a preferred operation of the system will be described in more detail. In operation, the flow path of air through the fuel injector 14 (FIG. 2) begins at the air filter 24. Air is drawn into the fuel injector either by an air pump (not shown) or by the vacuum created by the motion of the pistons in the engine. Air flows through the air filter 24, down the airway 85 (FIG. 7) in the main body 15, beneath the drop ejector 30 (FIGS. 4 and 9) on the slide body 26, out of the main body 15, and into the intake manifold 16 (FIG. 2). The airflow is from right to left in FIG. 2.

The flow path of the combustible liquid begins at the fuel reservoir 18 (FIG. 2). The liquid flows in a low pressure conduit (e.g. less than about 3 psi) from the reservoir to the main body 15, then through a resiliently deformable conduit at a low pressure (e.g. again less than about 3 psi) to the fuel inlet 41 on the slide body 26 (FIG. 9). The liquid flows through the pressure regulator 32, through several slots in the standpipe (not shown) in the bottom of the housing 28 to the drop ejector 30. The exemplary pressure regulator, preferably foam, maintains a slight negative pressure (relative to gauge thus creating a backpressure) at the back of the drop ejector so that the combustible liquid does not drool or run out of the drop ejector 30 during non-use. The liquid fuel is drawn out of the foam and into the drop ejector because of the capillary action of the fluid within the drop ejector and standpipe slots to replace the ejected volume. The drop ejector 30 fires the liquid drop-by-drop vertically downward into a fast flow of air channeled beneath the slide body 26. When the drops reach the air stream, their flight path changes from vertical to horizontal in this example. The drops are sufficiently small due to their discretely ejected quantum size. The airflow is designed such that mixing occurs between the air and the quantum drops of fuel, and a combustible vapor 17 (FIG. 2) is formed.

Referring to FIG. 10, motion of throttle cable 22, as indicated by the arrow 87, causes the throttle wheel 48 to rotate, as indicated by the arrow 88, and the slide body 26 to move up and down, as indicated by the arrow 89. The slide body 26 normally sits at the bottom of the slot 38 (FIG. 7), blocking the airway 85 and is urged downward by the return springs 46 (FIG. 4). When the throttle cable 22 is pulled away from the main body 15, the cable 22 causes the throttle wheel 48 to rotate and, in turn, pull the slide body 26 upward with the second throttle cable 54. The second throttle cable passes through the guide 45 (FIG. 8) and its motion is redirected from horizontal to vertical as illustrated in FIG. 10. The second throttle cable is attached to the arch 40 on the slide body top wall 35 (FIG. 9). When the slide body moves upward, more of the airway 85 is uncovered and more air is permitted to flow into the fuel injector 14. In addition, the return springs 46 are compressed. The rotation of the throttle wheel 48 also actuates the throttle position sensor 52 that sends a signal 68 to the electronic control module 20 indicating that more of the airway 85 is open and more air is flowing into the fuel injector.

Referring to the circuit in FIG. 12, when the throttle cable 22 (FIG. 2) is pulled away from the fuel injector, the output signal 68 from the throttle position sensor 52 increases. In turn, the electronic controller 76 increases load counter output signal 77, which is indicative of the number of fuel drops (n) to be ejected from the drop ejector 30. The higher load counter output signal 77 causes the pulse counter 79 to provide more pulses 80 to the drive circuits 91 within the given time frame $\tau_1$. Accordingly, the drive circuits 91 provide more pulses to the drop ejector 30, thus resulting in more fuel drops being ejected from the drop ejector 30, and ultimately more fuel being provided to the engine.

When the engine is running at steady state and an increased load is placed on the engine, the speed of the engine slows and also the flow of air through the fuel injector decreases. Either the decrease in revolutions of the engine or the decrease in airflow or both are sensed by the engine load sensor 72 and the output voltage signal 73 from the engine load sensor 72 changes to reflect the increased load. Based upon the increased input voltage 73, the electronic controller 76 increases the load counter output signal 77, indicative of the number of fuel drops to eject. As more combustible liquid is ejected into the air stream, the engine typically produces more torque up to a certain point where the combustible mixture becomes too rich, and it does not increase torque any longer. This process all occurs without moving the throttle cable 22. Alternatively, the load sensor may also affect the throttle position. If the increased load is removed, the engine typically speeds up since excess power is being generated, and the circuit operates to reduce the number of fuel drops ejected during the next time frame $\tau_1$. This is just the reverse of the process described immediately above.

Referring to FIG. 12, the electronic controller 76 receives inputs 68 and 73 from the throttle position sensor 52 and engine load sensor 72, respectively, which, in turn, causes the circuit to increase or decrease the number of fuel drops ejected from the drop ejector 30. In particular, at steady state, the position of the slide body 26 (FIG. 10) within the fuel injector determines the primary stoichiometric ratio of the air stream and the air charge going into the engine. During acceleration and deceleration, the controller 76 modifies the stoichiometric ratio based on the signal from the load sensor 27.

Under conditions of a very small load, as the slide body 26 opens the airway 85, more air is permitted to enter the fuel injector 14. Because there is very little load on the engine, the speed of the engine responds very quickly, and the revolutions of the engine come up to speed very easily. In this situation of low load, the output signal 73 from the engine load sensor 72 has very little affect on the number of fuel drops ejected from the drop ejector 30 during any given time period $\tau_1$.

Under conditions of increased load—as the engine load increases and without changing the throttle position—the output voltage signal 73 from the engine load sensor 72 changes the voltage input to the controller 76. In response, the electronic controller 76 causes the load counter signal 77, i.e., the number of desired fuel drops (n), to increase. More drops of combustible liquid are injected into the air stream, and the stoichiometric ratio is changed to increase the torque produced by the engine. The engine thus responds to the load, and equilibrium is reestablished.

The inventive apparatus offers an inexpensive, simple, reliable, electro-mechanical fuel delivery system for precisely controlling the fuel/air stoichiometry in the cylinders of an internal combustion engine or other combustible fuel devices such as lamps, stoves, generators and portable heaters to name a few. The inventive apparatus has the capability of precisely metering how much fuel is being delivered to the cylinders or devices with a resolution in a range of nanograms because both the size and weight of the drops of fuel being delivered by the micro-pump are precisely controlled in a discrete drop-by-drop manner. These features allow the engine or device to reduce the amount of hydrocarbons released into the atmosphere, in particular during start-up, and to meet increasingly stringent environmental regulations. The apparatus differs from conventional fuel injectors in that rather than forming a spray of fuel having varying drop sizes, a drop-by-drop generator in the micro-pump creates one or more quantums of fuel in fixed sized drops that are discretely ejected and that are readily vaporized when mixed with air. This ability to provide a fixed amount of fuel made up of a various amount of quantum sized drops creates a method of digitally delivering fuel to an engine, thus allowing for enhanced automated and preferably computerized control. By being able to efficiently blend the fuel and air, one benefit is that for a given application, lower grade fuels may be used thus leading to further economy.

In addition, the apparatus includes a low pressure, e.g. less than about 3 pounds per square inch, fuel supply system.

This low-pressure fuel supply system operates far below the high pressures found in conventional fuel injection systems. The drop ejector includes micro nozzles and capillary channels within a standpipe that are custom designed and sized for the type of fuel used. By adding a back pressure regulator between the drop ejector/standpipe and the low pressure fuel delivery system, fuel is prevented from leaking into the engine. Preferably, the apparatus is designed to allow the drop ejector to be easily replaceable by a consumer. This exchangeability of the drop ejector allows for easy maintenance of a fuel injection system, such as when the nozzles become clogged due to impurities in the fuel. Also, by allowing for removal and replacement of the drop ejector, various fuel types can be used in a given device and the proper drop ejector for the fuel type selected is simply exchanged and installed.

Further, the described method for ejecting drops of fuel (and the circuit to implement this method) according to a pulse-modulated scheme is beneficial because it is a non-complicated method for digitally controlling the drop ejector in a precise manner. The use of the circuitry to implement the pulse-modulated scheme allows for precise control of the fuel drops being ejected.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements. The invention is limited by the following claims.

What is claimed is:

1. A fuel delivery system, comprising:

a drop ejector having a nozzle capable of digitally ejecting discrete drops of a combustible liquid; and a means for providing a pulse-modulated control signal to said drop ejector, wherein said pulse-modulated control signal is indicative of a desired number of drops to be ejected from said drop ejector during a given time frame.

2. The fuel delivery system of claim 1, wherein said pulse-modulated control signal means is adapted to adjust said desired number of drops ejected within a given time frame in response to an operation condition input.

3. The fuel delivery system of claim 2, wherein the fuel delivery system is in fluid communication with an internal combustion engine, and said operation condition input relates to a load on said engine.

4. The fuel delivery system of claim 2, wherein said operation condition input relates to a throttle position.

5. The fuel delivery system of claim 1, wherein said pulse-modulated control signal means comprises:

an electronic controller responsive to an input signal indicative of an operation condition, wherein said electronic controller is adapted to provide an output signal indicative of a desired number of drops to eject from said drop ejector; and a pulse counter responsive to said electronic controller output signal.

6. A fuel delivery system, comprising:

a drop ejector having a nozzle capable of digitally ejecting discrete drops of a combustible liquid; and an electronic controller adapted to cause a desired number of drops to be ejected from said drop ejector during a given time frame.

7. The fuel delivery system of claim 6, wherein said electronic controller is adapted to adjust said desired number of drops ejected within a given time frame in response to an operation condition input.

8. The fuel delivery system of claim 7, wherein the fuel delivery system is in fluid communication with an internal combustion engine, and said operation condition input relates to a load on said engine.

9. The fuel delivery system of claim 7, wherein said operation condition input relates to a throttle position.

10. A method of delivering a combustible liquid to a fuel-powered apparatus, comprising the steps:

digitally ejecting discrete drops of the combustible liquid from a drop ejector; and adjusting a number of said drops ejected from said drop ejector during a given time frame in response to an operation condition of the apparatus.

11. The method of claim 10, wherein said operation condition is related to a throttle position.

12. The method of claim 10, wherein:

the apparatus is an internal combustion engine;

said operation condition is related to engine load; and said adjusting step comprises increasing said number of drops ejected from said drop ejector during a given time frame in response to an increased engine load.

13. A fuel injector, comprising:

a drop ejector having a nozzle capable of digitally ejecting discrete drops of a combustible liquid; and an electronic circuit in electronic communication with said drop ejector, wherein said electronic circuit determines a desired number of drops to be ejected by said drop ejector during a given time frame and provides a pulse-modulated control signal to said drop ejector indicative of said desired number of drops.

14. The fuel injector of claim 13, wherein said electronic circuit determines said desired number of drops based upon a signal indicative of an operation condition of a fuel-consuming apparatus, wherein said operation condition is selected from the group: (i) load on said fuel-consuming apparatus; and (ii) a throttle position of said fuel-consuming apparatus.

* * * * *